US006925276B2

(12) United States Patent
Iino

(10) Patent No.: US 6,925,276 B2
(45) Date of Patent: Aug. 2, 2005

(54) COLOR IMAGE FORMING APPARATUS

(75) Inventor: Tomohiro Iino, Sunto-gun (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/820,759

(22) Filed: Apr. 9, 2004

(65) Prior Publication Data

US 2004/0190942 A1 Sep. 30, 2004

Related U.S. Application Data

(63) Continuation of application No. 10/301,796, filed on Nov. 22, 2002, now Pat. No. 6,882,815.

(51) Int. Cl.[7] ..... G03G 15/01
(52) U.S. Cl. ..... 399/227
(58) Field of Search ..... 399/107, 119, 399/120, 222, 223, 226, 227

(56) References Cited

U.S. PATENT DOCUMENTS

| | | | | |
|---|---|---|---|---|
| 5,565,973 A | * | 10/1996 | Fujishiro et al. | 399/227 |
| 5,585,598 A | * | 12/1996 | Kasahara et al. | 399/227 |
| 5,991,569 A | | 11/1999 | Sugihara et al. | |
| 6,122,469 A | * | 9/2000 | Miura et al. | 399/227 |
| 6,647,232 B2 | * | 11/2003 | Suzuki | 399/227 |

FOREIGN PATENT DOCUMENTS

| | | |
|---|---|---|
| JP | 60-214377 | 10/1985 |
| JP | 05-323795 | 12/1993 |

* cited by examiner

*Primary Examiner*—Hoan Tran
(74) *Attorney, Agent, or Firm*—Foley & Lardner LLP

(57) ABSTRACT

An image forming apparatus has a positioning device which positions an image carrier out of contact with a revolver unit that holds a plurality of developing rollers in a direction of rotation, thereby defining a predetermined gap between each developing roller and the image carrier at a developing position.

10 Claims, 3 Drawing Sheets

COLOR IMAGE FORMING APPARATUS

CROSS-REFERENCE TO RELATED APPLICATIONS

This application is a continuation of U.S. application Ser. No. 10/301,796, filed Nov. 22, 2002 now U.S. Pat. No. 6,882,815, which is incorporated herein by reference in its entirety.

BACKGROUND OF THE INVENTION

The present invention relates to a color image forming apparatus realized as, for example, an electrophotography copy machine.

In some of the color image forming apparatuses of this type, toner images of different colors are sequentially formed on a photosensitive drum, and sequentially transferred onto an intermediate transfer medium in a superposed manner. The superposed toner images are simultaneously transferred from the intermediate transfer medium to a sheet of paper.

The development method as disclosed in, for example, Japanese Patent Application KOKAI Publication No. 60-214377 is known as a method for use in color image forming apparatuses. This method is of a so-called revolver type in which a plurality of developing units for different colors are provided on revolving units in the direction of revolution of the revolving units. The revolving units are revolved to align the developing units with a photosensitive drum one by one.

Each developing unit has a developing roller that rotates to supply toner. A predetermined gap is formed between the developing roller and photosensitive drum.

As seen from, for example, FIG. 5, positioning flanges 102, 102 have a diameter which is larger, by a predetermined value, than a photosensitive drum 101. The positioning flanges 102, 102 are provided at the opposite sides of the photosensitive drum 101 such that they are in contact with revolving units 103, 103, thereby defining a predetermined gap between the photosensitive drum 101 and a developing roller 104.

In the prior art, the positioning flanges 102, 102 are in direct contact with the revolving units 103, 103. Therefore, the vibrations of the revolving units 103, 103, which occur when they revolve, are transmitted to the photosensitive drum 101, thereby vibrating the photosensitive drum 101.

If the photosensitive drum 101 is exposed to form an electrostatic latent image while it is vibrating, the resultant electrostatic latent image is blurred, thereby degrading the image quality. To avoid this, in the prior art, an electrostatic latent image cannot be formed until the vibration of the photosensitive drum 101 ceases, with the result that the efficiency of image processing is inevitably reduced.

BRIEF SUMMARY OF THE INVENTION

The present invention has been developed in light of the above-described circumstances, and aims to provide an image forming apparatus in which revolver type developing units are positioned out of contact with an image carrier, thereby defining a predetermined gap between the image carrier and developing rollers.

According to an aspect of the invention, there is provided an image forming apparatus comprising: an image carrier which rotates; a latent image forming device which decomposes image information into a plurality of color information items, and emits, onto the image carrier, information light based on the decomposed color information items, thereby sequentially forming electrostatic latent images of different colors; a plurality of developing rollers which sequentially supply, at a developing position, respective color developers to the electrostatic latent images of different colors formed by the latent image forming device; a revolver unit which holds the developing rollers in a direction of rotation, and revolves the developing rollers about a shaft to move the developing rollers to the developing position; and a positioning device which positions the image carrier out of contact with the revolver unit, thereby defining a predetermined gap between each of the developing rollers and the image carrier at the developing position.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

The present invention will be described in detail with reference to the embodiment shown in the accompanying drawings.

Figure 1:
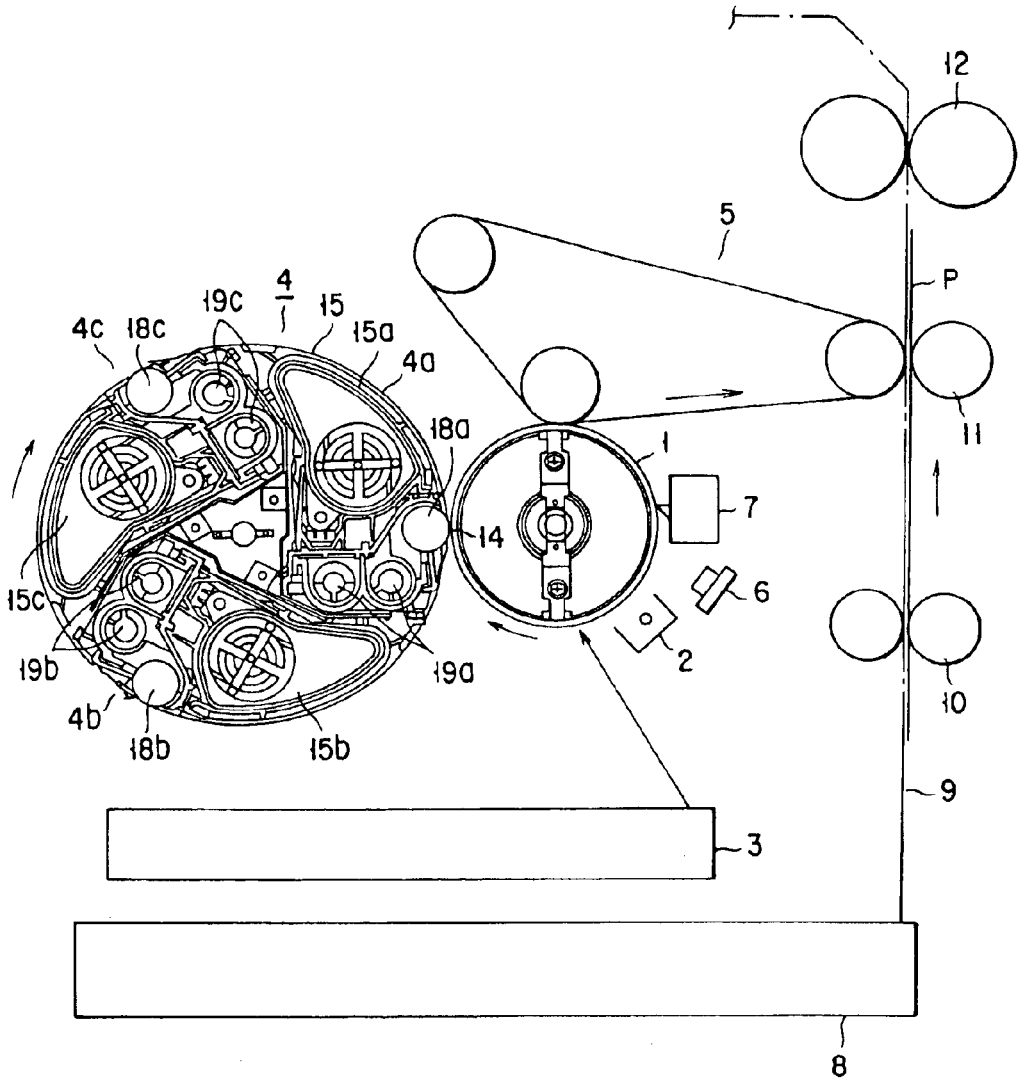
FIG. 1 is a schematic view illustrating the structure of an electrophotography copy machine according to an embodiment of the invention.

FIG. 1 is a view illustrating the structure of a color image forming apparatus using an electrophotography process, according to the embodiment of the invention.

In the figure, reference numeral 1 denotes a photosensitive drum as a rotatable image carrier. A charger 2, exposure unit 3 as a latent image forming device, revolver type developing device 4, intermediate transfer belt 5 as an intermediate transfer medium, cleaning unit 7 and deelectrifying unit 6 are provided in this order along the periphery of the photosensitive drum 1 in the direction of rotation.

A paper feed cassette 8 is provided below the photosensitive drum 1, and contains paper sheets as an image-transfer medium. Each of the paper sheets is picked up by a pickup roller (not shown) in accordance with the rotation of the roller, and is conveyed along a conveyance path 9. Along the conveyance path 9, a pair of conveyance rollers 10, transfer rollers 11 and fixing rollers 12 are provided in this order in the direction of conveyance.

The developing device 4 is of a revolver type, and has a holder 15 as a revolving member. The holder 15 is divided into first to third blocks 15*a* to 15*c*. The holder 15 is revolved clockwise by a revolver driving unit (not shown).

The first block 15*a*, second block 15*b* and third block 15*c* of the holder 15 hold developing units 4*a*, 4*b* and 4*c*, respectively.

The developing unit 4*a* contains cyan toner as a nonmagnetic one-component toner, mixer 19*a* for mixing and conveying the cyan toner, and developing roller 18*a* for supplying the photosensitive drum 1 with the cyan toner mixed and conveyed by the mixer 19*a*.

The developing unit 4*b* contains magenta toner as a nonmagnetic one-component toner, mixer 19*b* for mixing and conveying the magenta toner, and developing roller 18*b* for supplying the photosensitive drum 1 with the magenta toner mixed and conveyed by the mixer 19*b*.

The developing unit 4*c* contains yellow toner as a nonmagnetic one-component toner, mixer 19*c* for mixing and conveying the yellow toner, and developing roller 18*c* for supplying the photosensitive drum 1 with the yellow toner mixed and conveyed by the mixer 19*c*.

The developing units 4*a*–4*c* each have a layer forming member (not shown) for limiting the thickness of the toner on the developing rollers 18*a*–18*c* to a predetermined value, and charging the toner. A member formed of a phosphorous bronze plate spring and silicon chip attached to an end of the spring is used as the layer limiting member.

Each developing roller 18*a*–18*c* rotates with a predetermined gap between itself and the photosensitive drum 1, thereby developing an electrostatic latent image on the photosensitive drum 1. When the holder 15 rotates, the developing rollers 18*a*–18*c* are sequentially moved to a developing position 14 opposing the photosensitive drum 1.

A color image forming operation will now be described.

Firstly, the surface of the photosensitive drum 1 is uniformly charged by the charger 2 and scanned by information light, based on image information, output from the exposure unit 3, with the result that an electrostatic latent image is formed thereon. At this time, the image information to be exposed is monochrome image information such as yellow, magenta and cyan image information, which together provide a desired full-color image.

When an electrostatic latent image of, for example, cyan (hereinafter referred to as a "C latent image") has been formed on the photosensitive drum 1, the developing roller 18*a* is rotated before the front end of the C latent image reaches the developing position 14, thereby starting the development, using the cyan toner, of the C latent image, beginning from the front end. When the rear end of the C latent image has passed through the developing roller 18*a*, a cyan toner image is formed. Subsequently, the holder 15 of the revolver developing device 4 is swiftly revolved, thereby moving the developing unit 4*c* for the next color, Y, to the developing position 14 and executing the same operation as the above to form an image of the next color, i.e., Yellow, toner. After that, the developing unit 4*b* is moved to the developing position to form a magenta toner image.

The toner images of the respective colors formed on the photosensitive drum 1 are sequentially transferred, superposed, onto the intermediate transfer belt 5 that rotates in synchronism with the photosensitive drum 1.

On the other hand, at this time, each paper sheet P is fed from the paper cassette 8, conveyed on the conveyance path 9, and supplied to a transfer position between the transfer roller 11 and transfer belt 5. The toner images superposed upon each other on the intermediate transfer belt 5 are simultaneously transferred onto the paper sheet P conveyed to the transfer position. The paper sheet P with the resultant color image is conveyed to the fixing rollers 12, where the color image is fixed on the sheet. This sheet is discharged from the fixing rollers 12.

Figure 2:
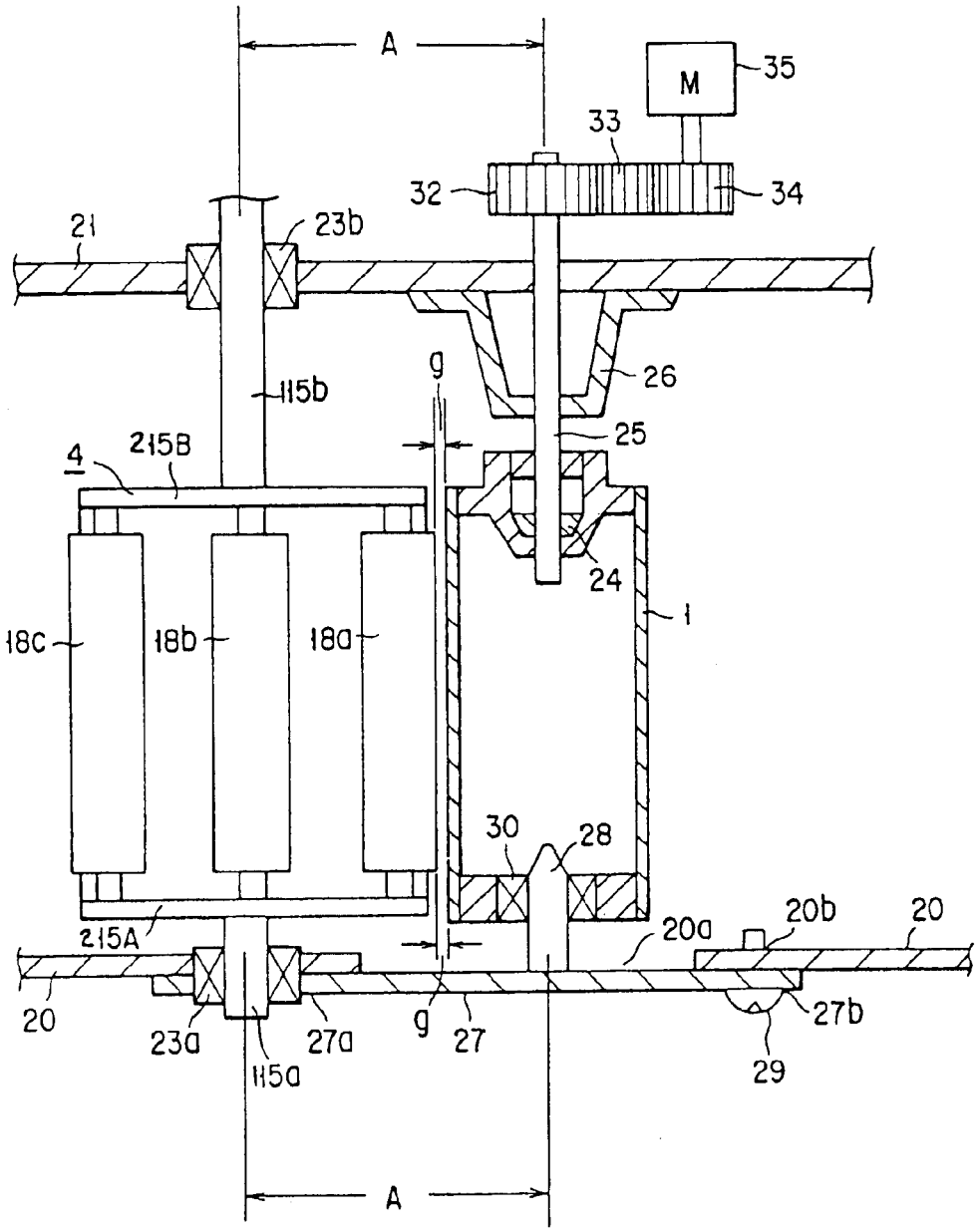
FIG. 2 is a transverse sectional view illustrating the attachment structure of a photosensitive drum and revolver type developing device.

FIG. 2 is a transverse sectional view illustrating the attachment structure of the photosensitive drum 1 and revolver developing device 4.

The photosensitive drum 1 and developing device 4 are interposed between a front plate 20 as a first plate section and a rear plate 21 as a second plate section, the first and second plate sections forming the main unit of the apparatus.

The holder 15 of the revolver developing device 4 has a first holding section 215A that holds the front portions of the developing rollers 18*a*–18*c*, and a second holding section 215B that holds their rear portions. A first shaft section 115*a* projects from the first holding section 215A, and a second shaft section 115*b* projects from the second holding section 215B. The first and second shaft sections 115*a* and 115*b* form a center shaft. The first and second shaft sections 115*a* and 115*b* are rotatably supported by the front and rear plates 20 and 21 via bearings 23*a* and 23*b*, respectively.

The photosensitive drum 1 has its rear portion connected to a driving shaft 25 by a coupling 24. The driving shaft 25 is rotatably supported by the rear plate 21 via a driving shaft holder 26.

Further, the front portion of the photosensitive drum 1 is held by a positioning plate 27 as a positioning device. The positioning plate 27 has an end attached to the first shaft section 115*a* of the revolver developing device 4 via the bearing 23*a*. A support pin 28 projects on a substantially central portion of the positioning plate 27. The other end of the positioning plate 27 is fixed to the front plate 20 by a fixing screw 29.

An opening 20*a* is formed in the front plate 20 for taking in and out the photosensitive drum 1, and is opposed to the positioning plate 27. The support pin 28 of the positioning plate 27 is inserted in a front-side bearing 30 incorporated in the photosensitive drum 1, and supports the photosensitive drum 1 so that the drum can rotate.

The rear portion of the driving shaft 25 projects rearwards from the rear plate 21, and a gear 32 is attached to the projection. The gear 32 is connected to a driving motor 35 via an idle gear 33 and driving gear 34.

When the driving motor is rotating, the driving shaft 25 is rotated via the driving gear 34, idle gear 33 and gear 32. The rotation of the driving shaft 25 is transmitted to the photosensitive drum 1 via the coupling 24, whereby the drum 1 is rotated.

A description will be given of the case of positioning the developing rollers 18*a*–18*c* with respect to the photosensitive drum 1.

Firstly, the first and second shaft sections 115*a* and 115*b* of the revolver developing device 4 are rotatably attached to the front and rear plates 20 and 21 by the bearings 23*a* and 23*b*, respectively. Subsequently, the photosensitive drum 1 is inserted through the opening 20*a* of the front plate 20, and the insertion-side end of the drum is connected to the driving shaft 25 by the coupling 24. After that, the first shaft section 115*a* of the revolver developing device 4 is inserted, via the bearing 23*a*, into an attachment hole 27*a* formed in one end of the positioning plate 27, and the support pin 28 provided at the central portion is inserted into the front-side bearing 30 of the photosensitive drum 1. After the insertion, the fixing screw 29 is inserted through an insertion hole 27*b* formed in the other end of the positioning plate 27, and is screwed into a screw hole 20*b* formed in the front plate 20.

As a result, the revolver developing device 4 and photosensitive drum 1 are positioned out of contact with each other, the distance between their rotation axes being A. The size A is designed greater by a predetermined amount than the sum of the radii of the revolver developing device 4 and photosensitive drum 1, thereby defining a predetermined gap (labeled "g") between each developing roller 18*a*–18*c* (when at the developing position 14) and the photosensitive drum 1.

A description will now be given of the case of exchanging the photosensitive drum 1 for another.

Figure 3:
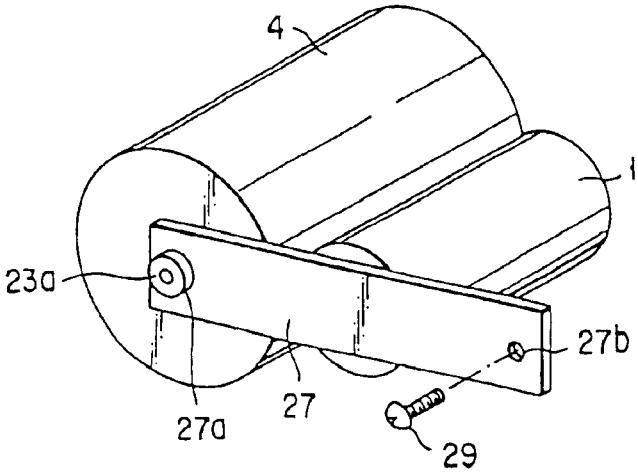
FIG. 3 is a perspective view illustrating a positioning plate used to position the photosensitive drum with respect to the revolver type developing device.
Figure 4:
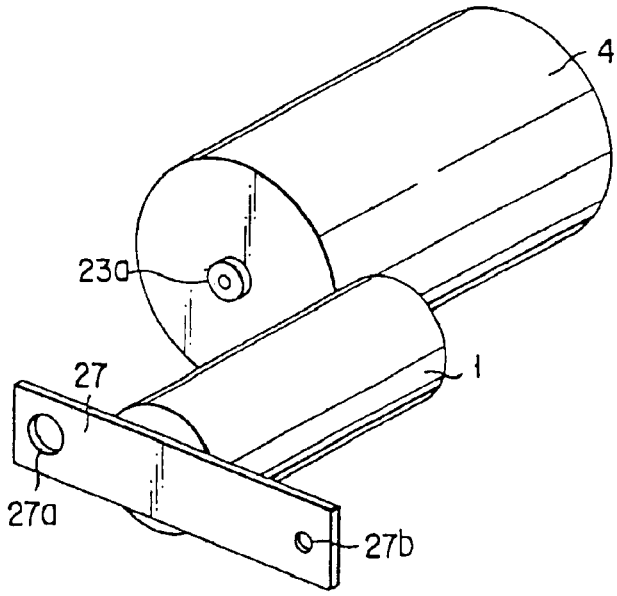
FIG. 4 is a perspective view illustrating an operation for exchanging the photosensitive drum.
Figure 5:
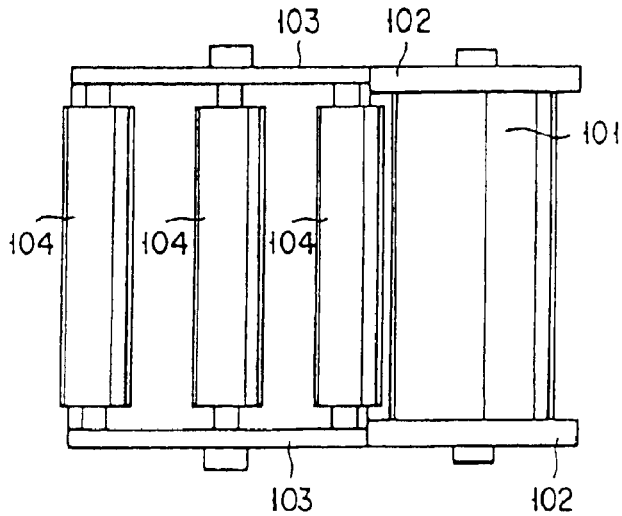
FIG. 5 PRIOR ART
FIG. 5 is a view illustrating the structure, employed in the prior art, of positioning a photosensitive drum with respect to revolver type developing units.

In this case, firstly, the fixing screw 29 of the positioning plate 27 is removed as shown in FIG. 3, and then the positioning plate 27 is pulled as shown in FIG. 4 to detach one end of the plate from the bearing 23*a* and draw the support pin 28 out of the bearing 30 of the photosensitive drum 1. Subsequently, the photosensitive drum 1 is detached from the driving shaft 25 and then from the main unit of the apparatus.

After detaching the photosensitive drum 1, a new photosensitive drum 1 is inserted into the interior of the apparatus through the opening 20*a* of the front plate 20, and the insertion-side end is coupled to the driving shaft 25 by the coupling 24. After that, the attachment hole 27*a* formed in the one end of the positioning plate 27 is engaged with the first shaft 115*a* of the revolver developing device 4 via the bearing 23*a*, and the central support pin 28 is inserted into the front-side bearing 30 of the photosensitive drum 1. After the insertion, the fixing screw 29 is inserted through the insertion hole 27*b* of the other end of the positioning plate 27, and screwed into the screw hole 20*b* of the front plate 20, which is the end of the exchange.

As described above, since the photosensitive drum 1 is positioned out of contact with the revolver type developing device 4, thereby defining a predetermined gap g between each of the developing rollers 18*a*–18*c* and the photosensitive drum 1, vibration of the revolver type developing device 4, which occurs when the device is rotating, is not transmitted to the photosensitive drum 1.

Therefore, unlike the prior art, the exposure process on the photosensitive drum 1 can be started promptly without waiting for the cease of vibration of the photosensitive drum 1. As a result, the efficiency of image processing is enhanced.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

an image carrier, which rotates about a shaft;

an exposure device for forming a latent image on the image carrier;

a plurality of developing devices each having a developing roller for developing the latent image at a developing position;

a revolver which holds the plurality of developing devices, said revolver sequentially moving each developing roller of the developing devices to the developing position by rotating about a shaft;

a support frame which rotatably supports the shaft of the revolver;

a positioning device, which positions the image carrier out of contact with the revolver by supporting the shaft of the revolver and that of the image carrier, and which defines a predetermined gap between each of the developing rollers and image carrier at the developing position;

an intermediate transfer member which is in contact with the image carrier at a top portion of the image carrier in a vertical direction, said intermediate transfer member carrying an image formed on the image carrier.

2. An image forming apparatus according to claim 1, wherein the developing position is on a lower side in the vertical direction than the contact position between the image carrier and the intermediate transfer member.

3. An image forming apparatus according to claim 1, wherein the exposure device is arranged at a position lower than the image carrier in the vertical direction.

4. An image forming apparatus according to claim 1, further comprising a sheet transfer device which transfers a sheet to a transfer point at which an image carried by the intermediate transfer member is transferred onto a sheet, wherein a sheet transfer direction at the transfer point is vertical.

5. An image forming apparatus according to claim 4, wherein the intermediate transfer member carries the image with a plurality of colors superposed, and transfers the image of the plurality of colors onto a sheet at the transfer point.

6. An image forming apparatus according to claim 1, wherein the positioning device supports the shaft of the revolver at one end of the positioning device, wherein the positioning device supports the shaft of the image carrier at a midpoint of the positioning device, and wherein the other end of the positioning device is fixed to the support frame.

7. An image forming apparatus comprising:

an image carrier;

an exposure device for forming a latent image on the image carrier;

a plurality of developing devices each having a developing roller for developing the latent image at a developing position;

a revolver which holds the plurality of developing devices, said revolver sequentially moving each developing roller of the developing devices to the developing position by rotating about a shaft;

a support frame which rotatably supports the shaft of the revolver;

a positioning device which positions the image carrier out of contact with the revolver, and defines a predetermined gap between each of the developing rollers and image carrier at the developing position;

an intermediate transfer member which is in contact with the image carrier at a top portion of the image carrier in a vertical direction, said intermediate transfer member carrying an image formed on the image carrier, wherein:

one end of the positioning device is attached to the shaft of the revolver;

the positioning device rotatably holds the image carrier at a midpoint of the positioning device; and the other end of the positioning device is fixed to the support frame.

8. An image forming apparatus comprising:

a first rotating member which rotates about a shaft;

first and second plates, which support both ends of the shaft of the first rotating member;

a second rotating member provided opposite to the first rotating member, said second rotating member rotating about a shaft; and a third plate having a hole, wherein the third plate supports the shaft of the second rotating member, said third plate forming a predetermined gap between the first and second rotating members by engaging the hole with the shaft of the first rotating member.

9. An image forming apparatus according to claim 8, wherein the shaft of the first rotating member is rotatably supported by a bearing.

10. An image forming apparatus according to claim 8, wherein one end of the third plate is fixed by a plate different from the plate that supports the first rotating member.

* * * * *